US005975093A

United States Patent [19]

Joulia

[11] Patent Number: 5,975,093

[45] Date of Patent: Nov. 2, 1999

[54] MAKEUP CASE WITH IMPROVED SEALING

[75] Inventor: Gerard Joulia, Paris, France

[73] Assignee: L'Oreal, Paris, France

[21] Appl. No.: 09/167,968

[22] Filed: Oct. 8, 1998

[30] Foreign Application Priority Data

Oct. 16, 1997 [FR] France ..... 97 12981

[51] Int. Cl.[6] ..... A45D 33/00

[52] U.S. Cl. ..... 132/293; 220/291

[58] Field of Search ..... 132/293, 294, 132/295, 296, 300, 301, 302, 303, 304, 305; 220/291, 292, DIG. 26; 215/243

[56] References Cited

U.S. PATENT DOCUMENTS

| | | | |
|---|---|---|---|
| 1,399,759 | 12/1921 | Fulenwider | 220/291 |
| 1,507,117 | 9/1924 | Johnson | 132/304 |
| 1,694,185 | 12/1928 | Leberman | 220/291 |
| 1,748,491 | 2/1930 | May | 220/291 |
| 2,466,295 | 4/1949 | Algier . | |
| 3,441,033 | 4/1969 | Flax | 132/295 |
| 5,542,561 | 8/1996 | Slink et al. . | |
| 5,632,394 | 5/1997 | Mecca et al. . | |

FOREIGN PATENT DOCUMENTS 533590 2/1941 United Kingdom .

*Primary Examiner*—Todd E. Manahan
*Attorney, Agent, or Firm*—Oblon, Spivak, McClelland, Maier & Neustadt, P.C.

[57] ABSTRACT

A case (1) has a bottom (2) which has a first screw thread (7), and a lid (3) with a second screw thread capable of engaging with the first screw thread (7), in order to screw (or unscrew) the lid onto (or from) the bottom. A connector (16) is capable, when the first screw thread (7) is not engaged with the second (8), of forming an articulation between the lid (3) and the bottom (2) so as to allow the case to be opened (or closed). The connector (16) is at least in part free to rotate with respect to either the bottom (2) or the lid (3) and connect the bottom (2) to the lid (3) regardless of their respective angular positions.

26 Claims, 4 Drawing Sheets

MAKEUP CASE WITH IMPROVED SEALING

BACKGROUND OF THE INVENTION

Field of the Invention

The present invention relates to a case of the makeup case type, used particularly in the field of cosmetics, for packaging and presenting products such as foundation in the form of a cream, a powder, a gel, or a paste, the products to be applied to the hair, or other make-up or body-care products. The invention can also be applied to other applications, particularly in the household domain. The invention is particularly suited to the packaging of products with a high content of solvent, especially water, and which have to be kept as airtight as possible so as to limit the evaporation of the solvent or solvents which they contain.

Cases suited to such products are described, in particular, in patent application EP-A-0,615,744. In this document, the case is of the type comprising a lid articulated to a bottom, closure means allowing the lid to be locked removably onto the bottom. A sealing means of the gasket type is arranged in the case, all around a recess capable of containing the product. The gasket consists of a water-absorbing material. Such a case, although simple to produce, does not offer sufficient sealing for certain applications.

Cases of a far more sophisticated design are described in patent application EP-A-0,614,629. In this document, the case comprises an internal lid mounted so that it is free to turn on an outer lid, and an internal bottom, mounted so that it is free to turn on an outer bottom. The internal lid can be screwed onto the bottom so that the product contained in a recess formed in the internal bottom can be kept under sealed conditions. The outer lid is articulated to the outer bottom so that once the internal lid has been detached from the external lid, the case can be opened by pivoting so that product can be applied using a powder puff contained in an auxiliary recess. Apart from being relatively bulky, this case suffers from a major drawback connected with its complexity, with the difficulty of using it (especially opening it), with its fragility and with its cost.

Still other cases are described in U.S. Pat. No. 5,186,318 or in patent FR 2,412,474. These cases are of a relatively complicated design. Furthermore, the seal they achieve is insufficient for some applications.

Still other cases are described in U.S. Pat. Nos. 2,466,295; 533,590; 5,632,394; and 5,542,561. All these cases have major drawbacks. One drawback relates to the complexity of their design, their bulk, and their aesthetic appearance, which is often incompatible with the demands of certain fields, such as that of cosmetics. Furthermore, some of them do not offer sufficient latitude in terms of the opening of the case and the accessibility of the product it contains. In the case of others, the sealing is insufficient or requires the presence of auxiliary sealing means, which therefore impinge adversely on the cost of the case.

SUMMARY OF THE INVENTION

One of the objects of the invention is to provide a case which solves all or some of the problems mentioned with reference to the conventional cases.

A further object of the invention is to provide a case which allows a product to be packaged in a sealed manner and which is robust, simple to use and economical to produce.

Yet a further object of the invention is to provide a case which has all the advantages of screw-top cases in terms of sealing, and all the advantages of articulated cases in terms of ease and convenience of use.

According to the invention, these and other objects are achieved by producing a case having a bottom which has a first screw thread and a lid which has a second screw thread capable of engaging with the first, for screwing (or unscrewing) the lid onto (or from) the bottom, and connecting element capable, when the first screw thread is not engaged with the second, of forming an articulation between the lid and the bottom so as to allow the case to be opened (or closed) by pivoting the lid with respect to the bottom about an axis perpendicular to the axis of the case. The connecting element comprises a head part guided in rotation inside a housing made in either the bottom or the said lid, via an opening into which the housing opens, so as to allow the lid to be screwed and unscrewed with respect to the bottom, and the second part for fastening the connecting element to the other of the lid or the bottom, the opening being arranged in a plane parallel to a plane on which the case closes.

The case thus offers all the advantages of a screw-top case in terms of sealing, but which can be opened in the manner of an articulated case, making it both simple and convenient to use. Furthermore, advantageously, the connection between the bottom and the lid is a permanent one, which is a sign of robustness. Indeed, if during screwing or unscrewing the case should fall, the lid cannot become detached from the bottom. The case is also simple to use and economical to produce. Finally, such a design, by positioning the connecting element inside the case, allows the bulk of the case to be limited and improves the aesthetic appearance of conventional cases. As the first part of the connecting element is brought into engagement with the corresponding part of the case via an opening situated opposite, or even in the closure plane, sealing does not require the use of additional sealing means. The presence of the housing opening preferably into the closure plane does not in any way adversely affect the sealing of the case. This is because the housing can actually be closed off by the other of the lid or bottom when the case is closed. When the case is in the open position, accessibility to the product inside the case is remarkable. The internal face of the lid may advantageously be used to incorporate a mirror, which can be used satisfactorily because of the way in which the case opens.

According to an advantageous embodiment, the bottom comprises a first wall bearing the first screw thread, the lid comprising a second wall bearing the second screw thread, the said second part being mounted at a fixed angular position in the other of the bottom or lid.

Advantageously too, the first wall is set back from an outer lateral edge of the bottom, the second wall being set back from an outer lateral edge of the lid, the first part being situated between the first wall and the outer lateral edge of the bottom, the second part being arranged between the second wall and the outer lateral edge of the lid.

Screwing and unscrewing the lid with respect to the bottom brings about an axial movement of the lid with respect to the bottom, it being possible for the first part of the connecting element to move axially by a distance at least equal to the axial movement.

According to a first embodiment, the first wall projects out from a plane on which the case closes, and on its external surface bears the first screw thread, the first wall delimiting a recess for a product, especially a powder, a cream, a gel, or a compact, the second wall being recessed from the plane on which the case closes. Thus, the second wall also delimits a recess which, advantageously, can be used to contain a mirror and/or an applicator of the powder puff type.

Advantageously, the recess forms an integral part of the bottom of the case. It is thus possible to produce the bottom and the lid of the case by molding a thermoplastic such as polypropylene. Alternatively, the first wall consists of one wall of an element attached to the bottom. Such an attached element may form a cup which is screwed into the bottom. This then produces a refillable structure which, in the case of a foundation for example, allows the color to be changed at will while keeping the same case.

According to an advantageous embodiment, the first part of the connecting element is guided in rotation inside a channel which extends over all or part of the periphery of the bottom or of the lid. Advantageously, means are provided for forming an axial stop for the first part, so as to keep the bottom connected to the lid regardless of their respective angular positions.

To make mold release easier in a case which is obtained by molding, the housing also opens to one face of the bottom or of the lid which is an opposite face to the said closure plane. Means may be provided for at least partially covering the face so as to conceal the housing. In the absence of such an open face, mold release may still be obtained by tearing.

The lid may be articulated to the bottom about an axis or about a point. The point or the axis is situated inside the lid or inside the bottom or between the two. However, as a preference, and in order to improve comfort in use, the articulation is located in the lid. Advantageously, when the case is in the open position, the lid can also pivot with respect to the bottom about at least one axis that is distinct from the axis of pivoting of the lid with respect to the bottom. Preferably, this axis is parallel to the axis of the case. A number of such axes may be obtained by attaching the connecting element via a ball joint connection. This improves the conditions under which the mirror inside the lid can be used.

Also preferably, the housing is made in the bottom of the case, the articulation being mounted in a fixed angular position on the lid, the lid being articulated to the bottom about an axis or about a point situated in the lid. The axis or the point of articulation may be produced by a rigid or semi-rigid rod, a film hinge or a ball joint.

In an advantageous embodiment, the case can be opened or closed, regardless of the angular position of the lid with respect to the bottom, when the first and second screw threads are not in mutual engagement. In this instance, the housing intended to contain the head part of the connecting element is situated entirely around the case. This makes the case easier to handle, and especially to close, it being possible for closure to begin whatever the angular position of the lid with respect to the bottom.

Alternatively, the first and second screw threads are in mutual engagement between a first angular position of the lid with respect to the bottom and a second angular position of the lid with respect to the bottom, which corresponds to a position in which the lid is fully screwed onto the bottom, the lid being articulated to the bottom at a third angular position adjacent to the first angular position. Typically, the first and second angular positions are separated by 90° to 180°. This period of mutual engagement of the screw threads is chosen as a function of the desired sealing, and of the desired speed with which the case is to be opened and closed.

Means may be provided for removably locking the connecting element in the third angular position. By way of example, the connecting element are locked in the third angular position by snap-fitting.

Purely by way of illustration, the first and second screw threads are in mutual engagement over between ¼ of a turn and two turns of the lid with respect to the bottom, and preferably over between ¼ of a turn and 1 turn of the lid with respect to the bottom.

Sealing means may be provided between the bottom and the lid. Such means supplement the sealing achieved by screwing the lid onto the bottom. These sealing means may consist of a gasket secured to the bottom or to the lid. Such a seal may be made of a polyethylene, silicone or rubber foam, etc. The gasket may be attached or obtained at the time-of molding with the part which bears it, particularly by overmolding, 2-shot injection molding or injection overmolding.

BRIEF DESCRIPTION OF THE DRAWINGS

Apart from the measures explained hereinabove, the invention may be understood with reference to the non-limiting embodiments illustrated in the appended Figures, in which.

DETAILED DESCRIPTION OF THE PREFERRED EMBODIMENTS

Figure 1:
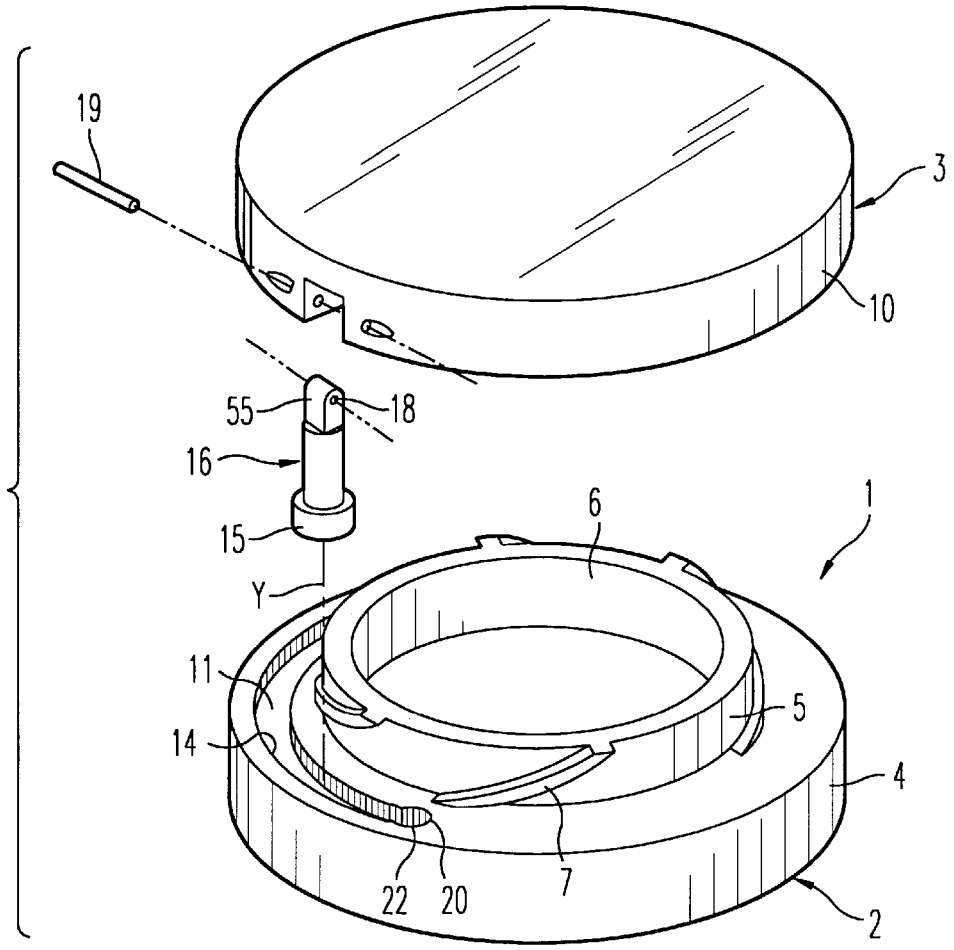
FIGS. 1 and 3A–3C and 4A–4D illustrate a first embodiment of the case according to the invention.

In the embodiment illustrated in FIG. 1, 3A–3C and 4A–4D, the case 1, of circular section, of axis X, comprises a bottom 2 and a lid 3. The bottom has, set back from its lateral edge 4, a wall 5 protruding out from the closure plane PF. The wall 5 delimits a recess 6 intended to contain a product P to be packaged. Such a product may consist of a powder, a gel, a cream, a block or cake, or a compact. By way of example, a foundation with a high water content, a product for applying to the hair, or an eye shadow may be packaged. The product may be compacted or poured hot or cold into the recess.

The outer surface of the wall 5 has a screw thread 7 capable of interacting with a corresponding screw thread 8 provided on the inside of a recessed wall 9 formed in the lid 3. Like the wall 5, the wall 9 is set back from the outer lateral edge 10 of the lid 3. Typically, these are set back by from 5 mm to 1 cm. The recessed wall 9 also delimits a housing 24 inside which a mirror 25 may be placed. Bonded to the periphery of the housing 24 is a gasket 26 capable, when the lid is closed on the bottom, of resting against the free edge of the wall 5, so as to improve the seal produced by screwing the lid onto the bottom.

Figure 3A:
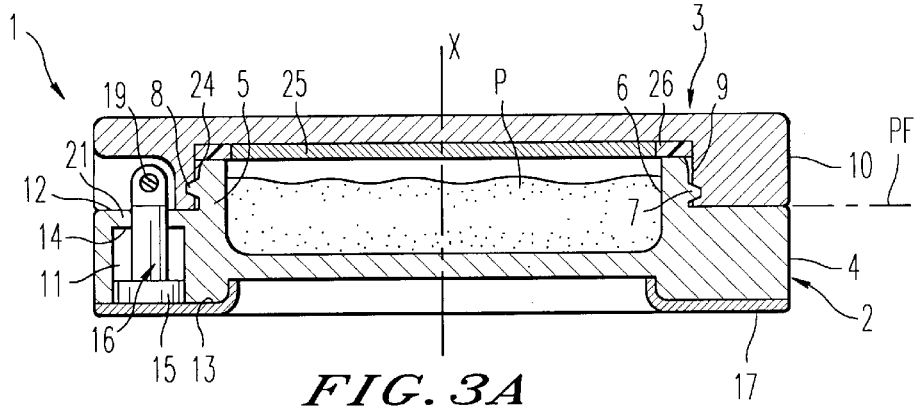
Figure 3B:
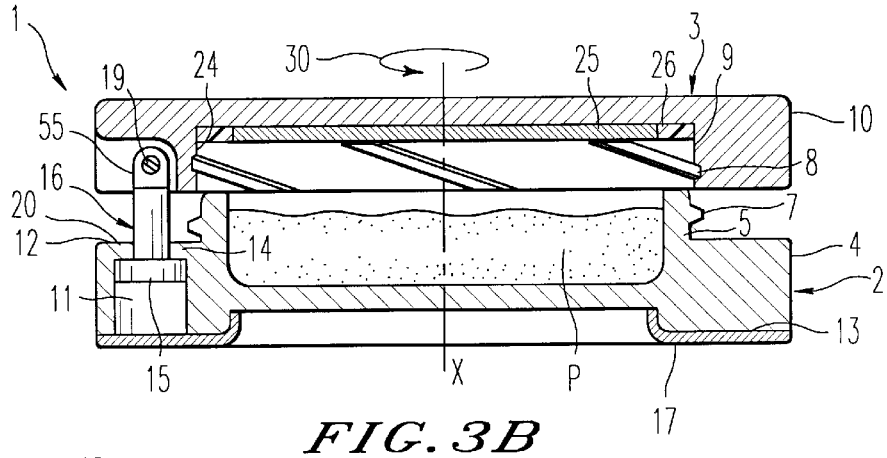
Figure 3C:
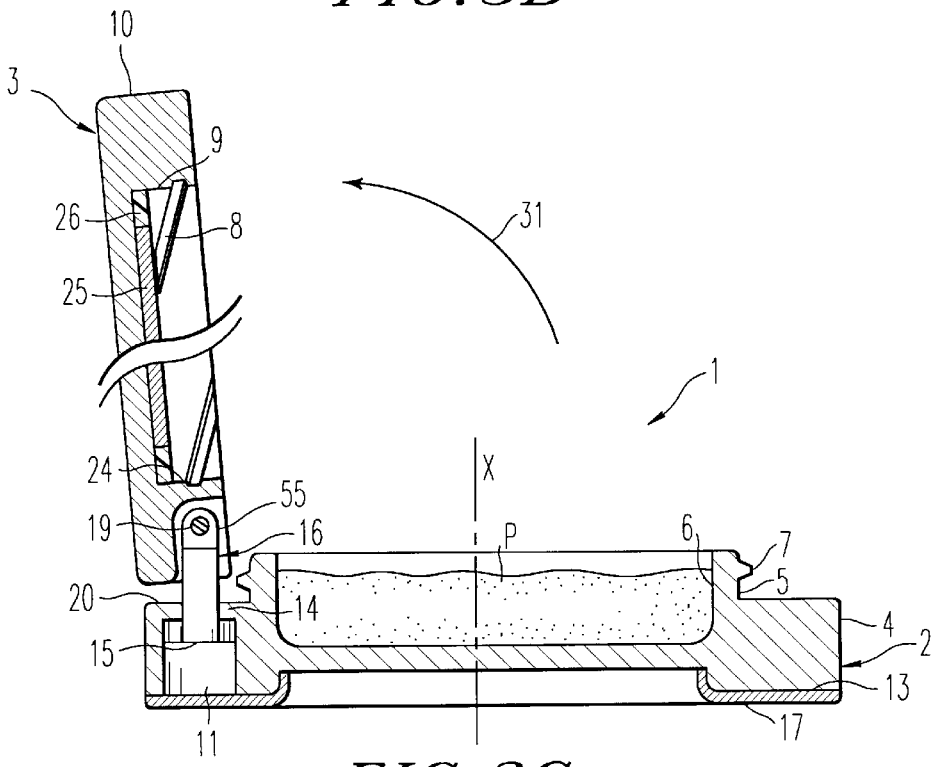

There is a housing 11 in the bottom 2 between the lateral edge 4 and the internal wall 5. The housing 11 opens to the closure plane over approximately 90°. As shown in FIGS. 3A–3C, such a housing 11 is in the form of a slot which opens both into the face 12 of the bottom, which face is adjacent to the closure plane PF, and into the opposite face 13. On the same side as the face 12, the slot has a rim 14 capable of forming an axial stop for a head part 15 of a connecting element 16 placed inside the housing 11. A closing-off element 17 is placed (by bonding or snap-fitting) on the face 13, so as to conceal the said housing 11. The axial height of the housing 11 is sufficient to allow an axial movement of the head part 15 in response to the axial movement of the lid with respect to the bottom when one of them is screwed or unscrewed with respect to the other.

The connecting element 16 is in the form of a cylindrical element, a first end of which is secured to the head part 15 whose section exceeds that of the cylindrical element, and exceeds the distance separating the two portions forming the rim 14. The other end of the element 16 forms an articulation portion 55 for attaching to the lid, and has a bore 18 arranged such that it comes opposite two corresponding bores in the lid 3 to receive an articulation pin 19 in the form of a rod, particularly made of brass. The connecting element is preferably free to rotate on itself inside the housing 11 so that when the case is in the open position, the lid can pivot with respect to the bottom about an axis Y parallel to the axis X of the case. This makes the use of the case more comfortable, particularly when this case has a mirror on the internal face of the lid.

To assemble the case, the connecting element 16 is inserted into the housing 11 via the face 13 of the bottom. The bore 18 of the attachment portion 55 is placed opposite the two corresponding bores in the lid 3. The pin 19 is introduced into the thus aligned bores. The pin 19 can be held in place by snap-fastening, or any other appropriate technique. The case is thus assembled. The attached bottom 17 is then fitted, either by bonding, snap-fastening, welding or fitted so that it holds itself in place.

In a first alternative form, pin 19 as the pivoting connection of the lid to the connecting element 16 is replaced by a film hinge, for example of polyethylene. Such an embodiment permits molding the lid and the connecting element to form a first part, and the bottom to form a second part. The head part 15 of the connecting element can be mounted in the housing 11 by snap-fastening because of the elastic deformability of the rim 14. This embodiment is particularly advantageous from an economic point of view.

At least one of the ends 22 (namely the end adjacent to the position in which the lid is unscrewed from the bottom) of the open part of the housing 11 ends in an enlargement 20 delimited by a slight restriction 56 formed by the rim 14, so that when the lid 3 is in this angular position with respect to the bottom 2, in which position the screw threads 7 and 8 of the bottom and of the lid respectively are no longer in engagement, the connecting element 16 is angularly immobilized. In this position, the lid 3 can be pivoted with respect to the bottom 2 by pivoting about the pin 19, so as to allow the case 1 to be opened or closed. The movement of the connecting element 16 into this position is accompanied by a slight noise which corresponds to the connecting element 16 having negotiated the restriction 56 by snap-fitting, which noise lets the user know that the case can be opened. A similar enlargement 21 may be arranged at the other end 23, so as to let the user know, when she has finished screwing the lid onto the bottom, that the case is adequately closed, thus avoiding any risk of deterioration of the product P it contains.

In the sectional view of FIG. 3A, the case is depicted in the closed position. In this position, the connecting element 16 is at the end of the housing 11 and within the enlargement 21. To open the case 1, the user unscrews the lid 3 with respect to the bottom 2 by turning one of them through about ¼ of a turn with respect to the other (arrow 30). The rotation of the lid with respect to the bottom is accompanied by an axial movement of one with respect to the other. This axial movement causes the head part 15 to rise up inside the housing 11. In this position, illustrated in FIG. 3B, the connecting element 16 is at the end of the housing 11, in the enlargement 20. The screw thread 7 of the bottom 2 is no longer engaged with the screw thread 8 of the lid 3. The connecting element 16 is angularly immobilized in the enlargement 20. The lid 3 can therefore be pivoted with respect to the bottom 2 about the pin 19 (arrow 31, FIG. 3C). The lid can also be oriented appropriately with respect to the bottom by turning the lid about the axis of the connecting element 16. The product can then be withdrawn in the conventional way, either by means of the fingers, or by means of a powder puff. The user then closes the lid 3 onto the bottom 2. She then screws the lid down onto the bottom 2 in the opposite direction to the direction illustrated by the arrow 30, and does so until the connecting element enter the enlargement 21. At this instant, the product is perfectly sealed inside the case.

Figure 2:
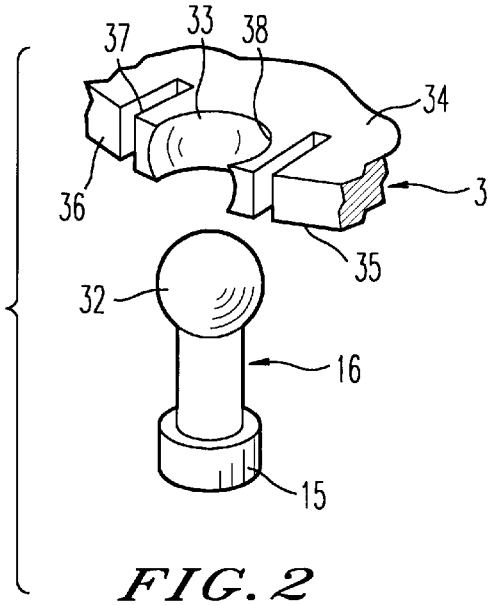
FIG. 2 illustrates an alternative form of the embodiment of FIGS. 1, 3A–3C, and 4A–4D.

FIG. 2 illustrates a second alternative form of the embodiment discussed earlier, in which the end of the connecting element 16, at the opposite end to that bearing the head part 15, ends in a ball joint 32 so as to allow the lid 3 to be articulated to the bottom 2 about a point. In this configuration, the ball joint is snap-fitted into a recess 33 formed in the lid, which recess opens to the two main faces 34, 35 of the lid 3, and to the edge 36. The recess is delimited by two elastically deformable tabs 37, 38 forming an integral part of the lid 3 and allowing the ball joint 32 to be snap-fitted into the recess 33. Thus mounted, the lid can pivot through 180° with respect to the bottom 2, which gives greater latitude in terms of the positioning of the bottom with respect to the lid. It can also pivot with respect to the bottom about an axis parallel to the axis of the case.

Figure 4A:
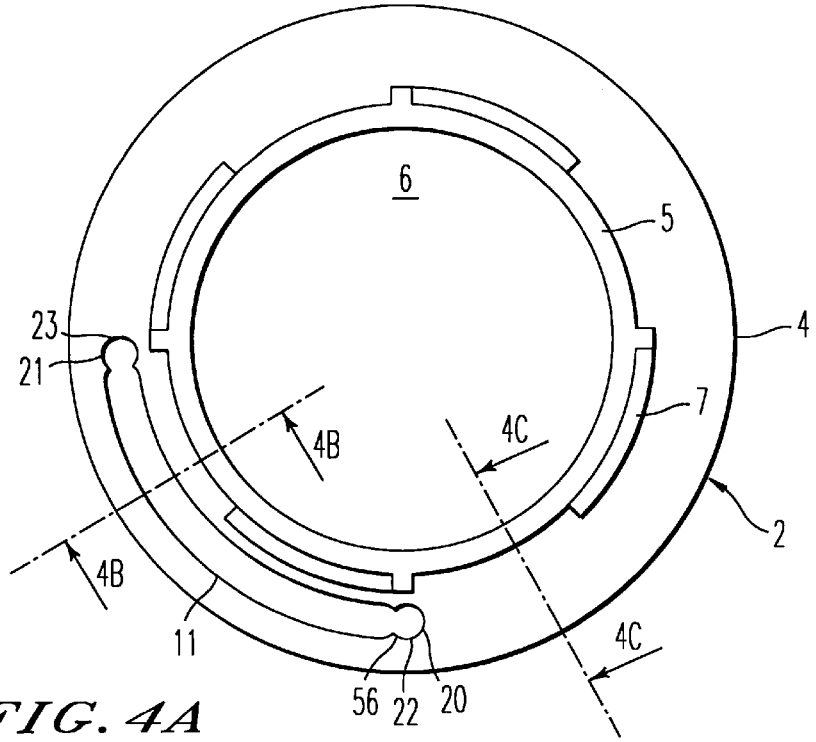
Figure 4B:
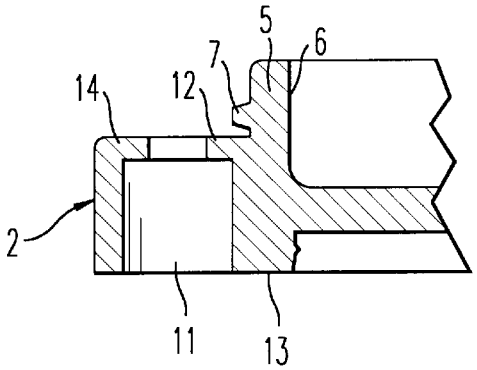
Figure 4C:
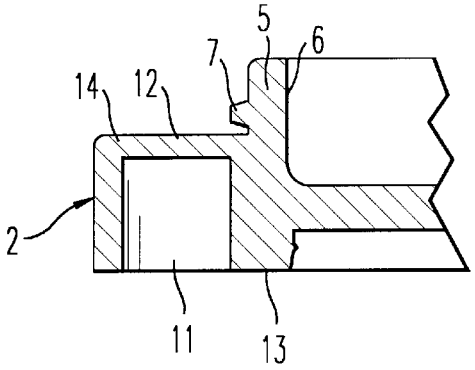
Figure 4D:
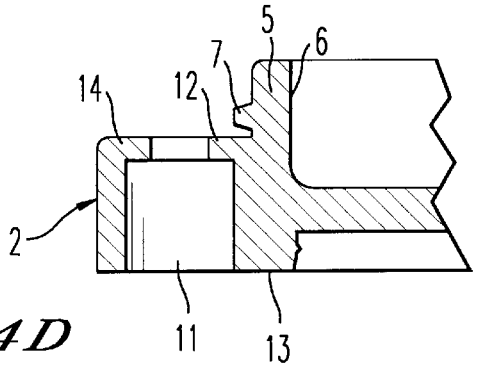

FIG. 4A illustrates a view from above of the bottom 2 of the case 1, in which the peripheral housing 11 is open over about 90°. As is clearly visible in the sectioned views of FIGS. 4B and 4C, the housing 11 consists of a slot extending entirely around the bottom and open to the face 13 of the bottom over the entire periphery of the bottom, so as to allow easier mold release. The housing 11 opens to the opposite face 12 over only about 90°, corresponding to the travel for screwing/unscrewing the lid onto/from the bottom. Such a bottom is obtained by molding using a two-part mold, with mold release both from above and from below. As mentioned earlier, the housing 11 ends at each of its ends 22, 23 in an enlargement 20, 21 capable of allowing indexing, both on closure and on opening of the case. The section of FIG. 4D illustrates another embodiment in which the housing 11 is formed of a slot extending over just an angular portion of the bottom (typically 90°) and opens to the face 12 of the bottom over the entire angular portion. The bottom 13 of the slot formed by the housing 11 is closed. Such an object is released from the mold by tearing.

Figure 5A:
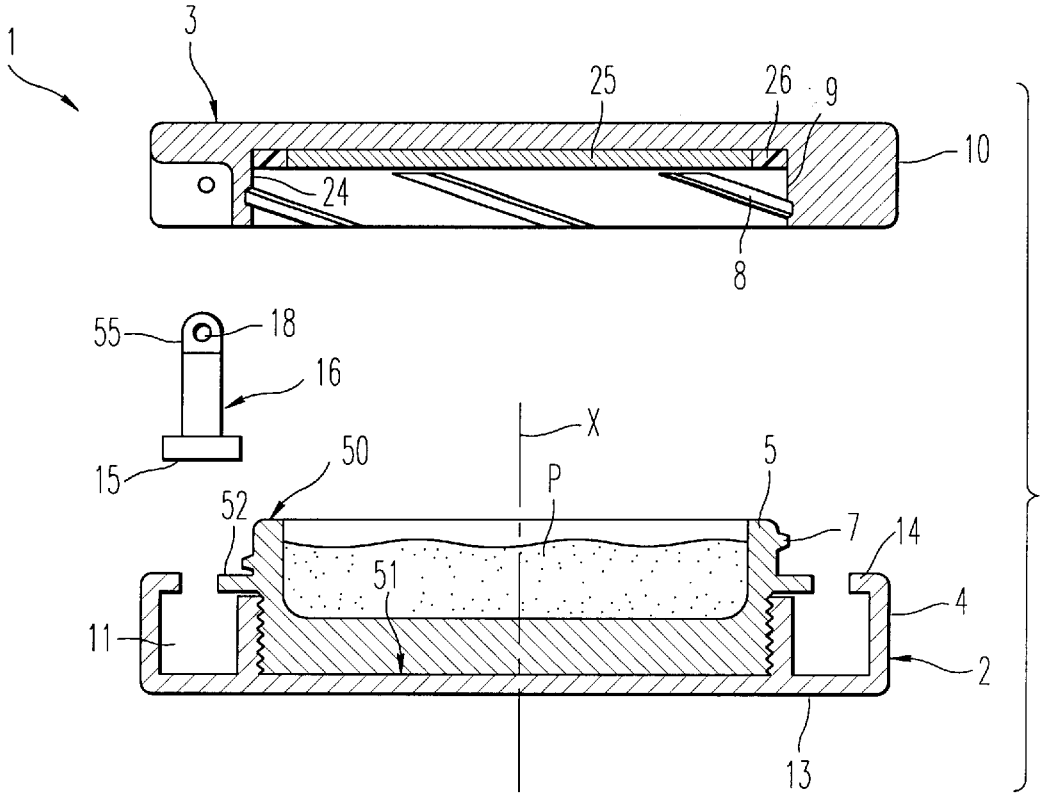
FIGS. 5A–5B depict another embodiment of the case according to the invention.
Figure 5B:
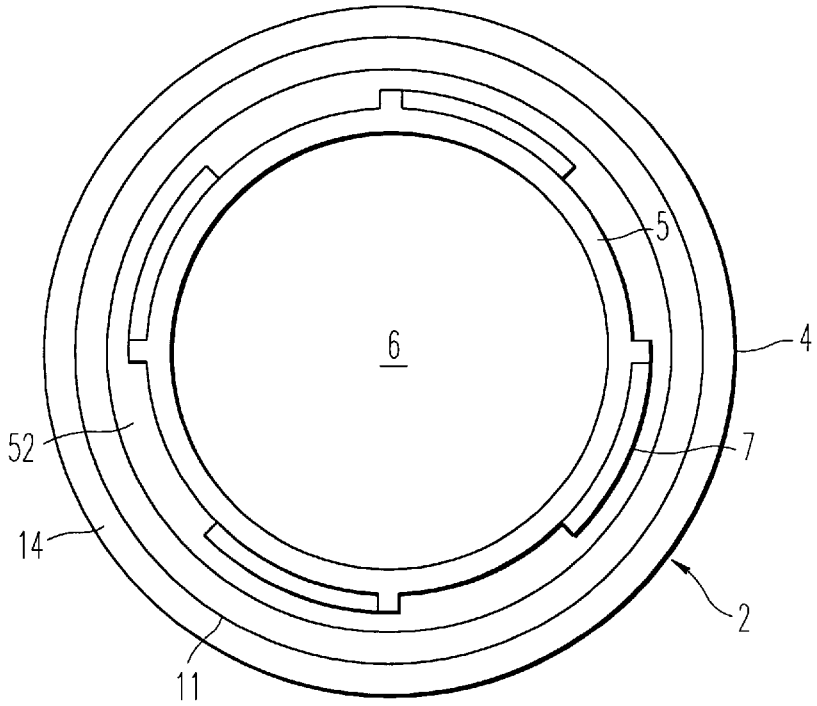

In the embodiment of FIGS. 5A and 5B, the case 1 can be distinguished from the one discussed with reference to the previous embodiments mainly in that the product P is contained inside a cup 50 screwed into a recess 51 made in the bottom. The wall 5 bearing the outer screw thread 7 is formed of the lateral wall of the cup 50. Part of the rim 14 is formed by a flange 52 formed on the outer surface of the wall 5, the other part being formed by the bottom itself. Furthermore, as is more clearly visible in the view from above of FIG. 5B, the housing 11 opens to the face 12 of the bottom 2 over the entire periphery thereof, so that the connecting element 16 are completely free to rotate with respect to the bottom 2. Thus, when the screw thread 7 of the bottom 2 and the screw thread 8 of the lid 3 have been disengaged, the lid can be pivoted into the open position with respect to the bottom 2, regardless or their respective angular positions. This embodiment makes it easier to close the case. The case can be closed easily from any angular position of the bottom 2 with respect to the lid 3, simply by turning the lid with respect to the bottom until their respective screw threads come into mutual engagement. Apart from these two characteristics, the case 1 is in all other respects identical to the case described earlier with reference to the preceding figures, and therefore requires no further detailed description.

In the foregoing detailed description, reference was made to preferred embodiments of the invention. Obviously, variations can be made thereto without departing from the spirit of the invention as claimed hereafter.

I claim:

1. A case comprising:

a bottom having a first screw thread;

a lid having a second screw thread engagable with the first screw thread for screwing the lid onto the bottom, one of said lid and said bottom defining an arcuate housing having an opening in a plane parallel to a plane on which the case closes; and a connecting element having a head part movable within the housing, said connecting element extending out of said housing via said opening, said connecting element comprising an articulation with the other of said lid and said bottom such that when the first screw thread is not engaged with the second screw head, the case may be opened by pivoting the lid with respect to the bottom about a pivot axis parallel to the plane on which the case closes.

2. The case according to claim 1, wherein screwing or unscrewing the lid with respect to the bottom causes circumferential and axial movement of said lid with respect to said bottom, the head part being capable of moving in said housing circumferentially and axially by distances at least equal to said circumferential and axial movement.

3. The case according to claim 1, wherein the bottom comprises a first wall bearing the first screw thread, the lid comprising a second wall bearing the second screw thread, the articulation comprising an articulation part mounted at a fixed angular position in the other of said bottom and said lid.

4. The case according to claim 3, wherein the first wall is set back from an outer lateral edge of the bottom, the second wall being set back from an outer lateral edge of the lid, wherein the head part is situated between the first wall and the outer lateral edge of the bottom, the articulation part being arranged between the second wall and the outer lateral edge of the lid.

5. The case according to claim 3, wherein the first wall projects oft from the plane on which the case closes and bears said first screw thread on its external surface, said first wall delimiting a recess for a product, the second wall being recessed from the plane on which the case closes.

6. The case according to claim 5, wherein said recess forms an integral part of the bottom of the case.

7. The case according to claim 5, wherein said first wall comprises one wall of an element attached into said bottom.

8. The case according to claim 7, wherein said attached element forms a cup which is screwed into said bottom.

9. The case according to claim 1, wherein said housing extends over at least part of the periphery of said one of the bottom and the lid.

10. The case according to claim 9, including means for forming an axial stop for said head part in said housing, so as to keep the bottom connected to the lid regardless of their respective angular positions.

11. The case according to claim 1, wherein said housing also opens to one face of said one of the bottom and the lid which is opposite to the closure plane.

12. The case according to claim 11, including means for at least partially covering said one face so as to conceal the housing.

13. The case according to claim 1, wherein the connecting element is constructed such that when the case is in an open position, the lid can pivot with respect to the bottom about an axis distinct from the articulation.

14. The case according to claim 13, wherein the lid is articulated to the bottom about a point.

15. The case according to claim 14, wherein the said point is located inside one of the lid and the bottom.

16. The case according to claim 13, wherein said articulation is defined by one of a rod, a film hinge and a ball joint.

17. The case according to claim 13, wherein the said pivot axis is located inside one of the lid and the bottom.

18. The case according to claim 1, wherein said housing is constructed such that the case can be opened regardless of the angular position of the lid with respect to the bottom when the said first and second screw threads are not in mutual engagement.

19. The case according to claim 1, wherein said first and second screw threads are in mutual engagement between a first angular position of the lid with respect to the bottom and a second angular position of the lid with respect to the bottom which corresponds to a position in which the lid is fully screwed onto the bottom, said lid being articulated to the bottom at a third angular position adjacent to said first angular position.

20. The case according to claim 19, including means for removably locking said connecting element in the third angular position.

21. The case according to claim 20, wherein said connecting element is locked in the third angular position by snap-fitting.

22. The case according to claim 1, wherein the first and second screw threads are in mutual engagement over between ¼ of a turn and two turns of the lid with respect to the bottom.

23. The case according to claim 1, including sealing means provided between the bottom and the lid.

24. The case according to claim 23, wherein said sealing means include a gasket secured to one of the bottom and the lid.

25. The case according to claim 1, containing a cosmetic product.

26. The case according to claim 1, wherein the housing is in said bottom, said connecting element being fixedly mounted on the lid, the lid being articulated to the bottom.

* * * * *

UNITED STATES PATENT AND TRADEMARK OFFICE

CERTIFICATE OF CORRECTION

PATENT NO. : 5,975,093

DATED : November 2, 1999

INVENTOR(S): GERARD JOULIA

It is certified that an error appears in the above-identified patent and that said Letters Patent is hereby corrected as shown below:

Col. 7, Claim 5, line 2, change "oft" to --out--.

Signed and Sealed this

Twentieth Day of March, 2001

*Attest:*

Nicholas P. Godici

NICHOLAS P. GODICI

*Attesting Officer*

*Acting Director of the United States Patent and Trademark Office*